US011208850B1

(12) United States Patent
Burris

(10) Patent No.: US 11,208,850 B1
(45) Date of Patent: Dec. 28, 2021

(54) DOWNHOLE TUBULAR SYSTEM, DOWNHOLE TUBULAR AND METHOD OF FORMING A CONTROL LINE PASSAGEWAY AT A TUBULAR

(71) Applicant: John Burris, Bixby, OK (US)

(72) Inventor: John Burris, Bixby, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 41 days.

(21) Appl. No.: 16/916,500

(22) Filed: Jun. 30, 2020

(51) Int. Cl.
*E21B 17/00* (2006.01)
*E21B 34/06* (2006.01)

(52) U.S. Cl.
CPC ..... *E21B 17/006* (2013.01); *E21B 34/063* (2013.01)

(58) Field of Classification Search
CPC ..... E21B 17/006; E21B 17/18; E21B 17/203; E21B 21/12; E21B 23/02; E21B 33/0355; E21B 33/0387; E21B 34/063; E21B 34/10
See application file for complete search history.

(56) References Cited

U.S. PATENT DOCUMENTS 4,566,540 A * 1/1986 Pringle ..... E21B 34/106 166/317
4,629,002 A * 12/1986 Pringle ..... E21B 34/101 166/324
4,791,991 A * 12/1988 Morris ..... E21B 34/10 166/319
5,799,949 A * 9/1998 Beall ..... E21B 17/025 166/319
6,260,850 B1 * 7/2001 Beall ..... E21B 17/025 166/242.3
6,880,641 B2 * 4/2005 Dennistoun ..... E21B 29/08 166/192
7,857,061 B2 12/2010 Richards
9,938,802 B2 4/2018 Sladic et al.
9,963,953 B2 5/2018 Lopez
10,030,477 B2 7/2018 Hornsby
2005/0230122 A1 * 10/2005 Cho ..... E21B 23/04 166/381
2018/0274299 A1 * 9/2018 Strange ..... E21B 7/067

FOREIGN PATENT DOCUMENTS

CN 205858261 U 1/2017

OTHER PUBLICATIONS

"Subsurface Safety Equipment", Halliburton Completion Tools; Jun. 2018; 42 pages.
International Search Report and Written Opinion; PCT Application No. PCT/US2021/070770; dated Sep. 27, 2021; 12 pages.

* cited by examiner

*Primary Examiner* — David Carroll
(74) *Attorney, Agent, or Firm* — Cantor Colburn LLP

(57) ABSTRACT

A downhole tubular system including a tubular defining a wall having an inner radial surface and an outer radial surface, the outer radial surface having a circumferential channel formed therein extending 360 degrees defining a punch portion, the inner radial surface defining an inner bore; a sleeve attachable around the tubular; and at least a portion of a control fluid chamber passageway defined between the sleeve and the outer radial surface, the wall occluding fluidic communication between the control line passageway and the inner bore until the punch portion has been punctured.

13 Claims, 1 Drawing Sheet

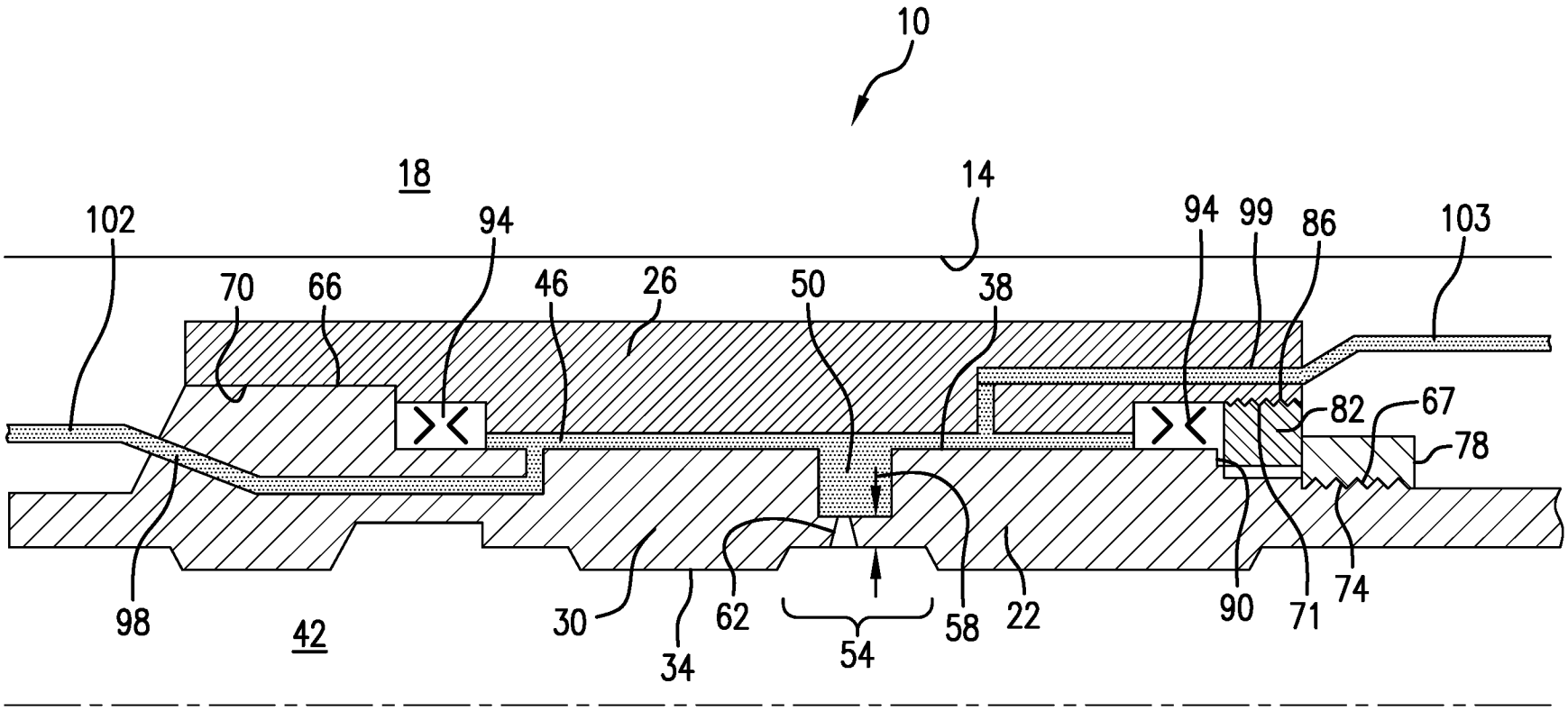
10
103
14
86
99
94
38
50
26
46
94
18
66
70
102
67
82
78
74
71
90
22
58
54
62
34
30
42
98

DOWNHOLE TUBULAR SYSTEM, DOWNHOLE TUBULAR AND METHOD OF FORMING A CONTROL LINE PASSAGEWAY AT A TUBULAR

BACKGROUND

In the resource recovery industry nipples are often employed to allow tools run downhole to connect to. Some nipples are tubulars that employ seals that create fluidic separation between an inner bore and a control line positioned radially outward of the nipple. While such nipples serve the purpose for which they were designed, the industry is always open to new configurations of nipples.

SUMMARY

Disclosed is an embodiment of a downhole tubular system including a tubular defining a wall having an inner radial surface and an outer radial surface, the outer radial surface having a circumferential channel formed therein extending 360 degrees defining a punch portion, the inner radial surface defining an inner bore; a sleeve attachable around the tubular; and at least a portion of a control fluid chamber passageway defined between the sleeve and the outer radial surface, the wall occluding fluidic communication between the control line passageway and the inner bore until the punch portion has been punctured.

Disclosed is an embodiment of a tubular for downhole use comprising a wall defining an inner radial surface and an outer radial surface, the outer radial surface having a circumferential channel formed therein extending 360 degrees defining a punch portion, the inner radial surface defining an inner bore, and the outer radial surface being configured to connect with a sleeve to define a control line passageway between the outer surface and the sleeve, the punch portion occluding fluidic communication between the inner bore and the control line passageway until punctured.

Disclosed is an embodiment of a method of forming a control line passageway at a tubular for downhole use including providing a tubular with a wall having an inner radial surface and an outer radial surface, the inner radial surface defining an inner bore, the outer radial surface having a channel formed 360 degrees around the tubular defining a punch portion; and providing a sleeve configured to be attached to the tubular such that a control line passageway is defined between the sleeve and the outer radial surface, the control line passageway being occluded from fluidic communication with the inner bore until an opening is punched through the punch portion.

BRIEF DESCRIPTION OF THE DRAWINGS

The following descriptions should not be considered limiting in any way. With reference to the accompanying drawings, like elements are numbered alike:

The FIGURE depicts a cross sectional view of a downhole tubular system disclosed herein.

DETAILED DESCRIPTION

A detailed description of one or more embodiments of the disclosed apparatus and method are presented herein by way of exemplification and not limitation with reference to the FIGURES.

Hydraulic control lines are often employed downhole to allow control of subsurface safety valves, and other tools, via changes in hydraulic pressure that is provided from surface through the control lines. In some systems the control lines terminate at a tubular, such as a nipple for example, while in others the control lines extend past tubulars. Regardless, it may be desirable to maintain fluidic separation between an inner bore of the tubular and a control line permanently or just until such time that fluidic communication is desired. One example when such separation would be desired is when a pressure needed to open a safety valve is less than pressure within the tubular, i.e. the inner bore. In such a case, were fluidic communication between the inner bore and the control line to be established then the valve could be stuck open, thereby preventing operation via pressure changes in the control line. While some tubulars are designed to maintain this fluidic separation, their construction might rely upon seals between tubulars that can fail over time due to deterioration from exposure to caustic fluids or mechanical loading, for example. Embodiments disclosed herein avoid the foregoing failure modes.

Referring to The FIGURE, a downhole tubular system 10 disclosed herein is illustrated downhole within a borehole 14 in a formation 18. The system 10 includes a tubular 22 and a sleeve 26. The tubular 22 has a wall 30 defining an inner surface 34 and an outer surface 38. An inner bore 42 is defined by the inner surface 34. A control fluid chamber 46 is defined between the outer surface 38 and the sleeve 26. The outer surface 38 has a channel 50 formed therein extending circumferentially 360 degrees around the tubular 22. A punch portion 54 of the tubular 22 is defined over a longitudinal extent by a consistent radial thickness 58 of material that the tubular 22 is made of between the inner surface 34 and the channel 50. The punch portion 54 is configured to be more easily punctured by a tool (not shown) run to the tubular 22, for the specific purpose of creating an opening 62 in the punch portion 54 when fluidic communication between the inner bore 42 and the control line 46 is desired. The punch portion 54, by extending 360 degrees around the tubular 22 negates a need to rotationally orientate a punching relative to the tubular 22 before performing a puncture operation.

The tubular 22 may be structurally weakened due to the presence of the channel 50. To alleviate this concern, the sleeve 26 can provide structural support in tension, compression, and even bending to the tubular 22. Threads 66 on the tubular 22 can be engaged with threads 70 of the sleeve 26 offset to one longitudinal side of the punch portion 54. Additionally, threads 67 on the tubular 22 can be engaged with threads 74 on a lock ring 78 that axially sandwiches a collar 82, with threads 86 that engage with threads 71 of the sleeve 26, against a shoulder 90 on the tubular 22. The threads 67 on the tubular 22 are offset longitudinally from the punch portion 54 on a side opposite the threads 66.

Seals 94 positioned to either longitudinal side of the punch portion 54 can sealingly engaged with both the tubular 22 and the sleeve 26 to maintain fluidic integrity of the control fluid chamber 46.

Fittings 98 and 99 can be positioned on either the tubular 22 or the sleeve 26 on opposite longitudinal sides of the punch portion 54 to allow connections to separate externally run control lines 102 and 103, respectively, depending upon the needs of a specific application.

Set forth below are some embodiments of the foregoing disclosure:

Embodiment 1: A downhole tubular system including a tubular defining a wall having an inner radial surface and an outer radial surface, the outer radial surface having a circumferential channel formed therein extending 360 degrees defining a punch portion, the inner radial surface defining an inner bore; a sleeve attachable around the tubular; and at least a portion of a control fluid chamber passageway defined between the sleeve and the outer radial surface, the wall occluding fluidic communication between the control line passageway and the inner bore until the punch portion has been punctured.

Embodiment 2: The downhole tubular system of any prior embodiment, wherein the sleeve provides at least one of tensile, compressive, and bending load support to the tubular.

Embodiment 3: The downhole tubular system of any prior embodiment, further comprising a collar, attachable to the sleeve and a lock ring attachable to the tubular.

Embodiment 4: The downhole tubular system of any prior embodiment, wherein the sleeve is threadably engaged with the tubular at at least one location.

Embodiment 5: The downhole tubular system of any prior embodiment, further comprising seals sealingly engageable with both the tubular and the sleeve offset to both longitudinal sides of the punch portion.

Embodiment 6: The downhole tubular system of any prior embodiment, wherein the punch portion has a consistent radial thickness around the full 360 degrees of the tubular.

Embodiment 7: The downhole tubular system of any prior embodiment, wherein an opening punched anywhere through the punch portion creates fluidic communication between the inner bore and the control line passageway through the opening.

Embodiment 8: A tubular for downhole use comprising a wall defining an inner radial surface and an outer radial surface, the outer radial surface having a circumferential channel formed therein extending 360 degrees defining a punch portion, the inner radial surface defining an inner bore, and the outer radial surface being configured to connect with a sleeve to define a control line passageway between the outer surface and the sleeve, the punch portion occluding fluidic communication between the inner bore and the control line passageway until punctured.

Embodiment 9: The tubular of any prior embodiment, wherein the punch portion is configured to allow fluidic communication between the inner bore and the control line passageway after an opening is punched through the punch portion.

Embodiment 10: The tubular of any prior embodiment, wherein the punch portion has a consistent radial thickness around the full 360 degrees of the tubular.

Embodiment 11: A method of forming a control line passageway at a tubular for downhole use including providing a tubular with a wall having an inner radial surface and an outer radial surface, the inner radial surface defining an inner bore, the outer radial surface having a channel formed 360 degrees around the tubular defining a punch portion; and providing a sleeve configured to be attached to the tubular such that a control line passageway is defined between the sleeve and the outer radial surface, the control line passageway being occluded from fluidic communication with the inner bore until an opening is punched through the punch portion.

Embodiment 12: The method of any prior embodiment, further including providing a collar for attaching between the tubular and the sleeve; and providing a lock ring for attaching between the tubular and the sleeve, the tubular, sleeve, collar and lock ring being configured such that when assembled together the sleeve provides structural support to the tubular.

Embodiment 13: The method of any prior embodiment, further comprising sealingly engaging the sleeve to the tubular at two longitudinal offsets from the punch portion.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tubular system comprising:

a tubular defining a wall having an inner radial surface and an outer radial surface, the outer radial surface having a circumferential channel formed therein extending 360 degrees defining a punch portion, the inner radial surface defining an inner bore;

a sleeve attachable around the tubular; and at least a portion of a control fluid chamber passageway defined between the sleeve and the outer radial surface, the wall occluding fluidic communication between the control line passageway and the inner bore until the punch portion has been punctured.

2. The downhole tubular system of claim 1, wherein the sleeve provides at least one of tensile, compressive, and bending load support to the tubular.

3. The downhole tubular system of claim 2, further comprising a collar, attachable to the sleeve and a lock ring attachable to the tubular.

4. The downhole tubular system of claim 1, wherein the sleeve is threadably engaged with the tubular at at least one location.

5. The downhole tubular system of claim 1, further comprising seals sealingly engageable with both the tubular and the sleeve offset to both longitudinal sides of the punch portion.

6. The downhole tubular system of claim 1, wherein the punch portion has a consistent radial thickness around the full 360 degrees of the tubular.

7. The downhole tubular system of claim 1, wherein an opening punched anywhere through the punch portion creates fluidic communication between the inner bore and the control line passageway through the opening.

8. A tubular for downhole use comprising a wall defining an inner radial surface and an outer radial surface, the outer radial surface having a circumferential channel formed therein extending 360 degrees defining a punch portion, the inner radial surface defining an inner bore, and the outer radial surface being configured to connect with a sleeve to define a control line passageway between the outer surface and the sleeve, the punch portion occluding fluidic communication between the inner bore and the control line passageway until punctured.

9. The tubular of claim 8, wherein the punch portion is configured to allow fluidic communication between the inner bore and the control line passageway after an opening is punched through the punch portion.

10. The tubular of claim 8, wherein the punch portion has a consistent radial thickness around the full 360 degrees of the tubular.

11. A method of forming a control line passageway at a tubular for downhole use comprising:

providing a tubular with a wall having an inner radial surface and an outer radial surface, the inner radial surface defining an inner bore, the outer radial surface having a channel formed 360 degrees around the tubular defining a punch portion; and providing a sleeve configured to be attached to the tubular such that a control line passageway is defined between the sleeve and the outer radial surface, the control line passageway being occluded from fluidic communication with the inner bore until an opening is punched through the punch portion.

12. The method of claim 11, further comprising:

providing a collar for attaching between the tubular and the sleeve; and providing a lock ring for attaching between the tubular and the sleeve, the tubular, sleeve, collar and lock ring being configured such that when assembled together the sleeve provides structural support to the tubular.

13. The method of claim 11, further comprising sealingly engaging the sleeve to the tubular at two longitudinal offsets from the punch portion.

* * * * *